US010978857B2

(12) United States Patent
Kuroda

(10) Patent No.: US 10,978,857 B2
(45) Date of Patent: Apr. 13, 2021

(54) METHOD OF MANUFACTURING SPARK PLUG THAT RELIABLY PREVENTS GASKET FROM COMING OFF MOUNTING SCREW

(71) Applicant: NGK SPARK PLUG CO., LTD., Nagoya (JP)

(72) Inventor: Keijiro Kuroda, Nagoya (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 16/800,376

(22) Filed: Feb. 25, 2020

(65) Prior Publication Data

US 2020/0274334 A1 Aug. 27, 2020

(30) Foreign Application Priority Data

Feb. 26, 2019 (JP) ..... 2019-032668

(51) Int. Cl.
*H01T 21/02* (2006.01)

(52) U.S. Cl.
CPC ..... *H01T 21/02* (2013.01)

(58) Field of Classification Search
CPC .... H01T 21/02; B23K 2103/04; B23K 26/21; B23K 2103/26
See application file for complete search history.

(56) References Cited

U.S. PATENT DOCUMENTS

| | | | | |
|---|---|---|---|---|
| 9,825,435 | B2 | 11/2017 | Kawai | |
| 2013/0225029 | A1* | 8/2013 | Kyuno | H01T 21/02 445/7 |
| 2014/0042894 | A1* | 2/2014 | Miyashita | H01T 13/08 313/144 |
| 2015/0171598 | A1 | 6/2015 | Suzuki | |
| 2016/0344167 | A1 | 11/2016 | Kawai | |
| 2018/0034245 | A1* | 2/2018 | Kawai | H01T 13/08 |

FOREIGN PATENT DOCUMENTS

| | | | |
|---|---|---|---|
| JP | 2013-149623 | A | 8/2013 |
| JP | 2015-133279 | A | 7/2015 |
| WO | 2013/179640 | A1 | 5/2013 |

* cited by examiner

*Primary Examiner* — Tracie Y Green
(74) *Attorney, Agent, or Firm* — Sughrue Mion, PLLC

(57) ABSTRACT

A method of manufacturing a spark plug (1) including a disposing step, a contacting step, and a deforming step. In the disposing step, a mounting screw portion (30) is inserted into a gasket (50) and the gasket (50) is disposed between the mounting screw portion (30) and a seat portion (32). In the contacting step, from a front end side, a jig (60) is brought into contact with the gasket (50) disposed by the disposing step, and the jig (60) is moved toward the rear end side until a load applied to the jig (60) from the gasket (50) reaches a predetermined set load. In the deforming step, after the contacting step, the jig (60) is further moved toward the rear end side by a predetermined set distance XS. Consequently, the gasket (50) is pressed by the jig (60) and an inner edge portion (55) of the gasket (50) is deformed inward in a radial direction of the gasket (50).

7 Claims, 6 Drawing Sheets

70
60
76
30
50
33
54
52

76
P1
64
56
60
54
50

XS
76
56
33
60
50

76
64
60
54
50

76
P1
64
56
60

XS
30
76
57
55
60
64

70
60
76
30
50
33
54
52

76
P1
64
56
60
33
54
50
52

30
XS
76
57
55
60
64

METHOD OF MANUFACTURING SPARK PLUG THAT RELIABLY PREVENTS GASKET FROM COMING OFF MOUNTING SCREW

BACKGROUND OF THE INVENTION

1. Field of the Invention

The present invention relates to a method of manufacturing a spark plug.

2. Description of the Related Art

A spark plug 100 disclosed by Patent Literature 1 includes a mounting screw portion 52, a flange-shaped seal portion 54, and a ring-shaped gasket 5. The gasket 5 is inserted around the mounting screw portion 52 and is disposed around a thread root 59 present between the mounting screw portion 52 and the seal portion 54. By pressing a jig against the gasket 5 from a side opposite to the side of the seal portion 54, a portion of an inner edge of the gasket 5 is pressed so as to be crushed, and deformed inward in a radial direction of the gasket 5. Thus, since the inside diameter of the gasket 5 becomes smaller than the maximum outside diameter of the mounting screw portion 52, such configuration suppresses the gasket 5 from coming off from the mounting screw portion 52.

PATENT LITERATURE

PTL 1: Japanese Unexamined Patent Application Publication No. 2013-149623

In the spark plug 100 disclosed by Patent Literature 1, the gasket must be deformed to a degree that does not allow the gasket to come off from the mounting screw portion 52. As a method of deforming the gasket 5 to a degree that does not allow the gasket 5 to come off from the mounting screw portion 52, for example, a method of pressing the gasket 5 by a jig until a load applied to the jig reaches a set load (for example, 10000 N) can be considered. When this method is used, since the gasket 5 can be deformed with a predetermined load, the gasket 5 can be deformed to a degree that makes it possible to suppress the gasket 5 from coming off from the mounting screw portion 52 by setting a proper set load. However, when the jig for deforming the gasket 5 repeatedly deforms the gasket 5, the jig wears. Therefore, even if the same load is exerted, a fitting depth of the jig with respect to the gasket 5 becomes smaller as the jig wears. Thus, the deformation amount of the gasket 5 is reduced, so that the probability of the gasket 5 coming off from the mounting screw portion 52 is increased.

SUMMARY OF THE INVENTION

The present invention has been made to address at least one of the above-described issues, and an object thereof is to reliably prevent a gasket from coming off from a mounting screw portion.

The above object has been achieved by providing (1) a method of manufacturing a spark plug, the spark plug comprising:

a cylindrical metal shell that includes a mounting screw portion and a seat portion, the mounting screw portion being formed at an outer periphery of a front end side of the metal shell, the seat portion being provided on a rear end side of the mounting screw portion and protruding outward in a radial direction, and a gasket that has a solid ring-shaped structure and that is disposed between the mounting screw portion and the seat portion, the method comprising:

a disposing step of inserting the mounting screw portion into the gasket and disposing the gasket between the mounting screw portion and the seat portion, a contacting step of bringing, from the front end side, a jig into contact with the gasket disposed by performing the disposing step, and moving the jig toward the rear end side until a load that is applied to the jig from the gasket reaches a predetermined set load, and a deforming step of, after the contacting step, further moving the jig toward the rear end side by a predetermined set distance to thereby press the gasket by the jig and deform an inner edge portion of the gasket inward in a radial direction of the gasket.

According to this configuration, after the load applied from the gasket has reached the set load, the jig moves toward the rear end side by the set distance. Therefore, after the jig has come into contact with the gasket and has been subjected to the set load, the jig is further pressed into the gasket by the set distance. Thus, since the pressing depth of the jig is suppressed from being smaller than expected, a situation in which the inner edge portion of the gasket is not sufficiently deformed inward in the radial direction due to the pressing depth of the jig being smaller than expected can be prevented. Therefore, according to this configuration, it is possible to more reliably prevent the gasket from coming off from the mounting screw portion.

In a preferred embodiment (2) of the method (1) above, in the contacting step, the gasket is pressed by the jig to form a concave portion in the gasket at least when the load applied to the jig has reached the set load.

For example, when the gasket is disposed in an improper posture that is tilted with respect to the seat portion, and the contacting step is finished with the gasket in an improper posture, the jig is further moved toward the rear end side of the spark plug by the set distance from the state in which the gasket is not sandwiched by the jig and the seat portion. As a result, the gasket may not be properly deformed.

However, according to this configuration, in the contacting step, a load that allows the concave portion to be formed in the gasket is exerted upon the gasket, and when the load has reached the set load, the concave portion is formed in the gasket by pressing the jig. Therefore, for example, even if the gasket is disposed in the improper posture, the gasket is subjected to a load that allows the concave portion to be formed in the gasket, and thereby the posture of the gasket is corrected before proceeding to the deforming step. Then, the contacting step can be finished in a state in which the gasket is sandwiched by the jig and the seat portion having been produced. Therefore, according to this configuration, a situation in which the gasket is not properly deformed due to the deforming step having been started with the gasket in an improper posture can be suppressed.

In another preferred embodiment (3) of the method (1) or (2) above, the jig includes a ring-shaped claw portion on one end of the jig. Further, in the deforming step, the gasket may be pressed by the claw portion in a form of a ring over an entire circumference in a circumferential direction of the gasket.

According to this configuration, since pressure is easily exerted uniformly over the entire circumference in the circumferential direction of the gasket, the gasket is easily deformed uniformly over the entire circumference in the circumferential direction.

In yet another preferred embodiment (4) of the method of any of (1) to (3) above, in the contacting step, an abnormality is judged to have occurred when the load applied to the jig has not reached the set load even though the jig has reached a predetermined reference position.

According to this configuration, when the load applied to the jig has not reached the set load even though the jig has reached a position where the load applied to the jig should reach the set load, it is possible to detect that an abnormality has occurred.

In yet another embodiment (5) of the method of any of (1) to (4) above, in the deforming step, an abnormality is judged to have occurred when the load applied to the jig is less than or equal to a predetermined reference load even after the jig has moved by the set distance.

For example, when the gasket has been disposed in an improper posture that is tilted with respect to the seat portion and the contacting step is finished with the gasket in an improper posture, the jig is moved further toward the rear end side of the spark plug by the set distance from the state in which the gasket is not sandwiched by the jig and the seat portion. As a result, the gasket may not be properly deformed. However, according to this configuration, an occurrence of such an abnormality is easily detected. The details are as follows.

For example, in a case where the load applied to the jig has reached the set load with the gasket in an improper state, the posture of the gasket may be corrected to the proper posture thereafter when the gasket has been further pressed by the jig in the deforming step. When the posture of the gasket assumes a proper posture, the gasket becomes movable between the jig and the seat portion, so that a pressing force from the jig is not easily exerted upon the gasket. Therefore, a situation in which the load applied to the jig is less than or equal to the predetermined reference load when the jig has moved by the set distance may occur. When the load applied to the jig is less than or equal to the predetermined reference load even after the jig has moved by the set distance, an abnormality is judged to have occurred.

Therefore, an occurrence of an abnormality in which the gasket is not properly deformed due to the gasket being disposed in the improper posture is easily detected.

In yet another embodiment (6) of the method of any of (1) to (5) above, the gasket is a copper gasket.

According to this configuration, the above-described gasket can be a gasket having high seal ability and durability.

According to the present invention, it is possible to reliably prevent the gasket from coming off from the mounting screw portion.

DESCRIPTION OF THE PREFERRED EMBODIMENTS

The invention is next described in greater detail with reference to the drawings. However, the present invention should not be construed as being limited thereto.

1. First Embodiment

1-1. Structure of Spark Plug 1

Figure 1:
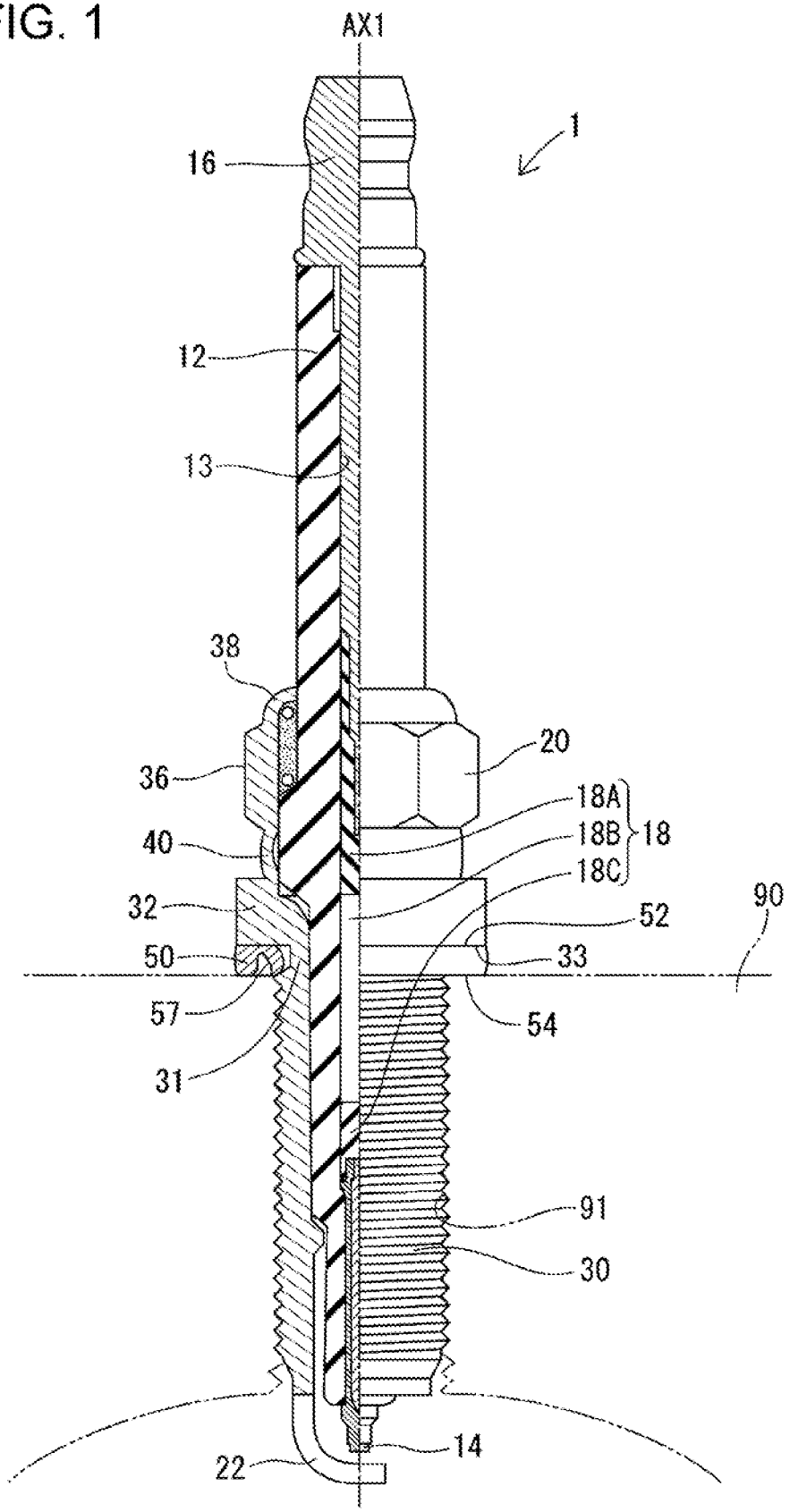
FIG. 1 is an explanatory view illustrating an entire structure of a spark plug.

A spark plug 1 shown in FIG. 1 has an elongated columnar shape along a first axial line AX1 indicated by an alternate long and short dashed line. The right side of the first axial line AX1 indicates an external side view and the left side of the first axial line AX1 indicates a sectional view of the spark plug 1 in a section passing through the first axial line AX1. In FIG. 1, a lower side in a sheet plane is a front end side of the spark plug 1 (one side in the direction of the first axial line AX1), and an upper side in the sheet plane is a rear end side of the spark plug 1 (the other side in the direction of the first axial line AX1). Among directions perpendicular to the first axial line AX1, the direction toward the first axial line AX1 is an inner side in a radial direction, and a direction away from the first axial line AX1 is an outer side in the radial direction.

The spark plug 1 includes an insulator 12, a center electrode 14, a metal terminal 16, a connection portion 18, a metal shell 20, and a ground electrode 22.

The insulator 12 has a cylindrical shape. An axial hole 13 extending along the first axial line AX1 is formed in the insulator 12. The insulator 12 is disposed between the center electrode 14 and the metal shell 20 and between the metal terminal 16 and the metal shell 20, so that the insulator 12 insulates the center electrode 14 and the metal shell 20, and the metal terminal 16 and the metal shell 20.

The center electrode 14 is a rod-shaped electrode extending along the direction of the first axial line AX1. The center electrode 14 is disposed in the axial hole 13 of the insulator 12 with a part of the center electrode 14 exposed from a front end side of the insulator 12.

The metal terminal 16 is a terminal to which electrical power is supplied and has a rod shape. The metal terminal 16 is disposed in the axial hole 13 of the insulator 12 with a part of the metal terminal 16 exposed from a rear end portion of the insulator 12.

The connection portion 18 is disposed between the metal terminal 16 and the center electrode 14 in the axial hole 13. From the side of the metal terminal 16, the connection portion 18 includes a first seal body 18A, a resistor 18B, and a second seal body 18C in this order. The connection portion 18 electrically connects the center electrode 14 and the metal terminal 16 to each other.

The metal shell 20 is a cylindrical metallic member and is provided at the outer periphery of the insulator 12 so as to surround at least a part of the insulator 12.

The ground electrode 22 is an electrode whose rear end side is joined to a front end side of the metal shell 20. The ground electrode 22 is bent so that its front end side and the center electrode 14 form a spark discharge gap therebetween.

The above-described metal shell 20 includes a mounting screw portion 30, a thread root portion 31, a seat portion 32, a tool engagement portion 36, a crimping portion 38, and a buckling portion 40.

The mounting screw portion 30 extends in a form of a shaft toward the front end side of the spark plug 1. The mounting screw portion 30 is formed at an outer periphery of the front end side of the metal shell 20.

The thread root portion 31 is formed at a rear end side of the mounting screw portion 30. An outer peripheral surface of the thread root portion 31 has a circular shape with the first axial line AX1 as the axis. The outside diameter of the thread root portion 31 is smaller than the maximum outside diameter of the mounting screw portion 30.

The seat portion 32 is provided further to the rear end side than the mounting screw portion 30 and has a shape protruding outward in the radial direction. In the plane direction orthogonal to the first axial line AX1, the seat portion 32 has a shape protruding more outward than the maximum outside diameter of the mounting screw portion 30. The seat portion 32 has a cylindrical shape with the first axial line AX1 as the axis (in the embodiment shown in FIG. 1, a circular cylindrical shape). The seat portion 32 has a seat surface 33 facing the front end side of the spark plug 1. The above-described thread root portion 31 is disposed between the mounting screw portion 30 and the seat portion 32.

The tool engagement portion 36 is provided further to the rear end side than the seat portion 32. The tool engagement portion 36 is a portion with which a tool (for example, a spark plug wrench) for mounting the spark plug 1 onto an engine 90 engages, and has a substantially polygonal shape (such as a substantially hexagonal shape) when seen from the direction of the first axial line AX1. The crimping portion 38 is provided further to the rear end side than the tool engagement portion 36 and is bent inward in the radial direction. The buckling portion 40 is a thin-walled portion provided between the seat portion 32 and the tool engagement portion 36.

The spark plug 1 includes a gasket 50. The gasket 50 is a copper gasket. The gasket 50 has a solid ring-shaped structure, and is manufactured, for example, by punching a metallic disk. The inside diameter of the gasket 50 manufactured by punching is larger than the maximum outside diameter of the mounting screw portion 30 and the outside diameter of the thread root portion 31. The outside diameter of the gasket 50 is substantially the same as the outside diameter of the seat surface 33 (the seat portion 32).

The gasket 50 has a first surface 52 facing the seat surface 33 when the gasket 50 has been inserted around the mounting screw portion 30 from a front end side of the mounting screw portion 30, and a second surface 54 on a side opposite to the first surface 52. Though described in detail below, the gasket 50 is inserted around the mounting screw portion 30 and is disposed between the mounting screw portion 30 and the seat portion 32 (that is, at the outer periphery of the thread root portion 31). Then, a jig 60 (see FIG. 2) is pressed against the second surface 54, and thereby the gasket 50 is deformed so that an inner edge portion 55 of the gasket 50 protrudes inward in the radial direction of the gasket 50. As a result, the inside diameter of the gasket 50 becomes smaller than the maximum outside diameter of the mounting screw portion 30, so that the gasket 50 is prevented from coming off from the mounting screw portion 30.

In the state in which the gasket 50 is prevented from coming off from the mounting screw portion 30, the mounting screw portion 30 of the spark plug 1 is mounted to an internally threaded mounted screw portion 91 of the engine 90 (more specifically, an engine head). Thus, the spark plug 1 is mounted on the engine 90. When the spark plug 1 is mounted on the engine 90, the gasket 50 is interposed between the seat portion 32 and the engine 90. Thereby, gas leakage from between the spark plug 1 and the engine 90 is suppressed.

1-2. Jig 60

Figure 2:
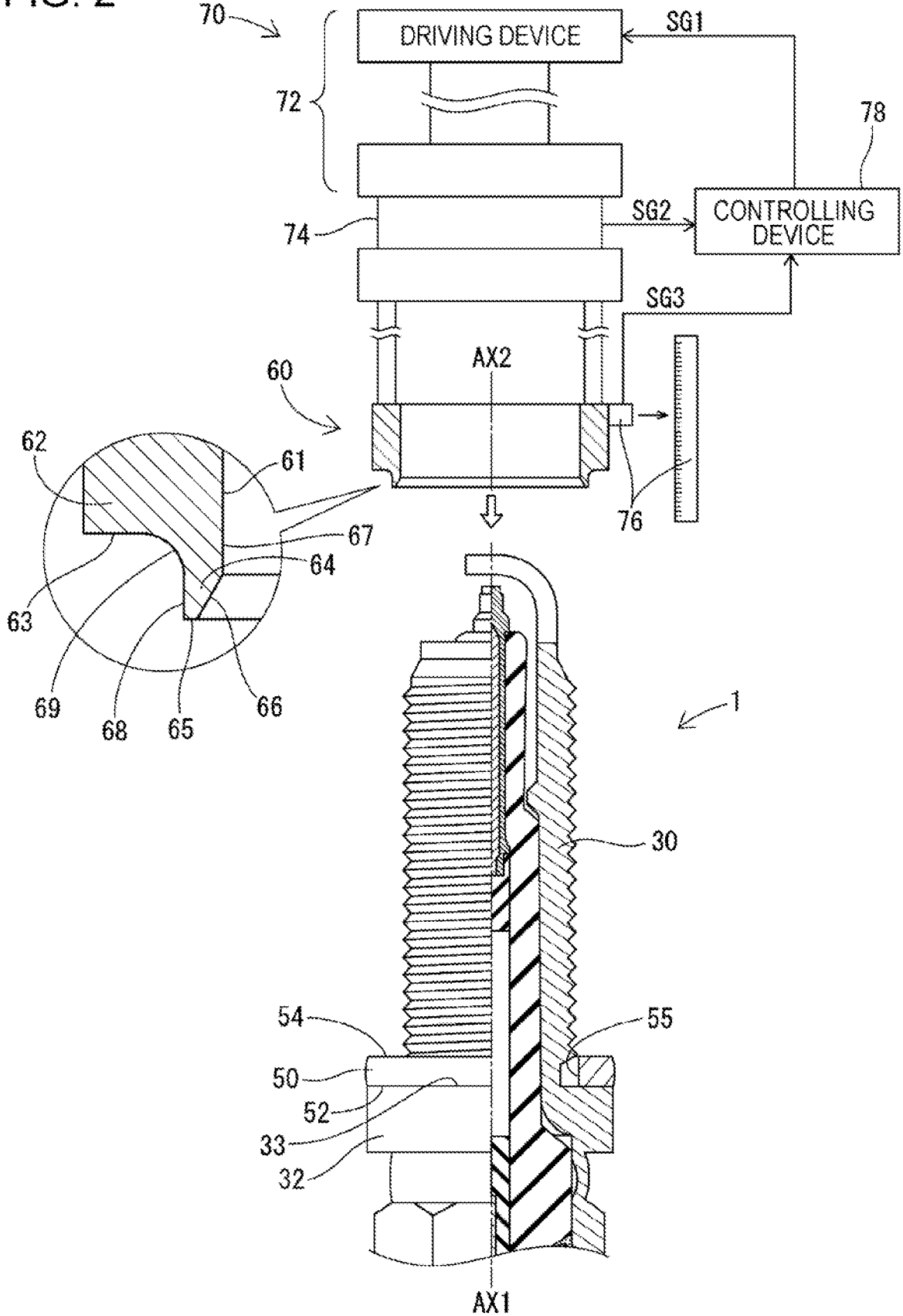
FIG. 2 is an explanatory view illustrating a structure of a pressing machine and a jig.

The jig 60 is a tool for pressing and deforming the gasket 50. The jig 60 shown in FIG. 2 has a shape extending along a second axial line AX2 in a form of a shaft. In FIG. 2, a lower side in a sheet plane is a front end side of the jig 60 (one side in the direction of the second axial line AX2), and an upper side in the sheet plane is a rear end side of the jig 60 (the other side in the direction of the second axial line AX2). In FIG. 2, the lower side in the sheet plane is the rear end side of the spark plug 1 (the other side in the direction of the first axial line AX1), and the upper side in the sheet plane is the front end side of the spark plug 1 (the one side in the direction of the first axial line AX1). Among directions perpendicular to the second axial line AX2, the direction toward the second axial line AX2 is a radially inner side of the second axial line AX2, and a direction away from the second axial line AX2 is a radially outer side of the second axial line AX2.

The jig 60 includes a trunk portion 62 and a claw portion 64. The trunk portion 62 has a cylindrical shape (in the example shown in FIG. 2, a circular cylindrical shape) extending along the second axial line AX2.

The claw portion 64 is a portion that presses and deforms the gasket 50. The claw portion 64 is formed on the front end side of the jig 60. The claw portion 64 protrudes toward the front end side from a front-end-side end surface of the trunk portion 62. The claw portion 64 has a shape whose sectional area becomes smaller toward a front end side from a rear end side of the claw portion 64.

A front-end-side end surface of the claw portion 64 is a contact surface 65 that contacts the gasket 50 when the contact surface 65 presses the gasket 50. The contact surface 65 extends in a plane direction perpendicular to the direction of the second axial line AX2.

A first inner surface 66 and a second inner surface 67 are formed on an inner side of the claw portion 64. The first inner surface 66 is continuous with an edge portion of the contact surface 65 on the radially inner side of the second axial line AX2, and is tapered toward a radially inner side of the second axial line AX2 in the jig 60 from the front end side toward the rear end side of the claw portion 64. The second inner surface 67 is continuous with a rear end portion of the first inner surface 66 and extends along the direction of the second axial line AX2.

A first outer surface 68 and a second outer surface 69 are formed on an outer side of the claw portion 64. The first outer surface 68 is continuous with an edge portion of the contact surface 65 on the radially outer side of the second axial line AX2, and extends along the direction of the second axial line AX2. The second outer surface 69 is continuous with a rear end portion of the first outer surface 68, and extends away toward the radially outer side of the second axial line AX2 from the front end side toward the rear end side of the claw portion 64.

A front end portion of the second outer surface 69 is provided to the rear end side of the jig 60 than a rear end portion of the first inner surface 66.

The claw portion 64 protrudes toward the front end side of the jig 60 from a portion of the front-end-side end surface of the trunk portion 62 on the radially inner side of the second axial line AX2. A portion of the front-end-side end surface of the trunk portion 62 on the radially outer side of the second axial line AX2 has a planar surface 63 extending along a plane direction orthogonal to the direction of the second axial line AX2. A rear end portion of the above-described second outer surface 69 is continuous with the planar surface 63.

The contact surface 65 of the claw portion 64 has a ring-shaped structure with the second axial line AX2 as the axis. Since the first inner surface 66 has a tapered shape whose inside diameter is reduced toward the rear end side from the front end side of the claw portion 64, the minimum inside diameter of the first inner surface 66 is equal to the inside diameter of the second inner surface 67. The inside diameter of the second inner surface 67 is larger than the maximum outside diameter of the mounting screw portion 30.

1-3. Pressing Machine 70

A pressing machine 70 is a machine that moves the jig 60 fixed thereto and presses the jig 60 against the gasket 50. The pressing machine 70 includes a driving device 72, a load detecting portion 74, a position detecting portion 76, and a controlling device 78.

The driving device 72 receives a control signal SG1 from the controlling device 78. Thereby, the driving device 72 causes the jig 60 fixed to the pressing machine 70 to move toward the rear end side of the spark plug 1 (in a direction toward the gasket 50) or toward the front end side of the spark plug 1 (in a direction away from the gasket 50).

The load detecting portion 74 is a sensor that detects the load applied to the jig 60, and is constituted, for example, as a load cell. The load detecting portion 74 outputs a signal SG2 indicating the detected load toward the controlling device 78.

The position detecting portion 76 is a sensor that detects the position of the jig 60, and is constituted, for example, as a linear scale. In the example shown in FIG. 2, the position detecting portion 76 is a reflection optical linear scale and includes a light-emitting element, a light-receiving element, and a scale. The light-emitting element and the light-receiving element are fixed to an outer peripheral portion of the jig 60. The position detecting portion 76 can detect the position of the jig 60 from a light reception state of the light-receiving element. The position detecting portion 76 outputs a signal SG3 indicating the position of the jig 60 detected by the position detecting portion 76 toward the controlling device 78.

The controlling device 78 is constituted, for example, as a microcontroller, and includes a processor, such as a CPU, and a memory, such as ROM or RAM. The controlling device 78 supplies the control signal SG1 to the driving device 72. Thereby, the controlling device 78 can drive the driving device 72 so as to move the jig 60 in a direction toward the gasket 50 or in a direction away from the gasket 50. The controlling device 78 can acquire the signal SG2 from the load detecting portion 74, and can acquire the load applied to the jig 60 based on the signal SG2. The controlling device 78 can acquire the signal SG3 from the position detecting portion 76, and can acquire the position of the jig 60 based on the signal SG3. On the basis of signal SG3, the controlling device 78 can detect the absolute position of the jig 60 within a movement range of the jig 60. Also, the controlling device 78 can detect the relative position of the jig 60 with reference to a predetermined position within the movement range of the jig 60.

1-4. Method of Manufacturing Spark Plug 1

In a method of manufacturing the spark plug 1, the ground electrode 22 is joined to the metal shell 20. The center electrode 14 and the metal terminal 16 are each assembled to the insulator 12. The insulator 12 is inserted into the metal shell 20. By crimping the crimping portion 38 by a crimping device (not shown), the metal shell 20 is integrated with the insulator 12. A front end of the ground electrode 22 is bent by a bending tool (not shown). The gasket 50 is mounted on the metal shell 20. As a result, the spark plug 1 is completed. The gasket 50 may be mounted on the metal shell 20 before bending the ground electrode 22.

Using FIGS. 2 to 6, the process of mounting the gasket 50 onto the metal shell 20 is described in detail. The process of mounting the gasket 50 onto the metal shell 20 includes a disposing step, a contacting step, and a deforming step.

In the process of mounting the gasket 50 onto the metal shell 20, a front end side of the spark plug 1 without the gasket 50 is fixed facing upward. The spark plug 1 without the gasket 50 and the jig 60 are disposed in such a manner that the first axial line AX1 and the second axial line AX2 are aligned on the same straight line.

The disposing step is a step of inserting the mounting screw portion 30 into the inner side of the gasket 50 and disposing the gasket 50 between the mounting screw portion 30 and the seat portion 32.

Figure 3:
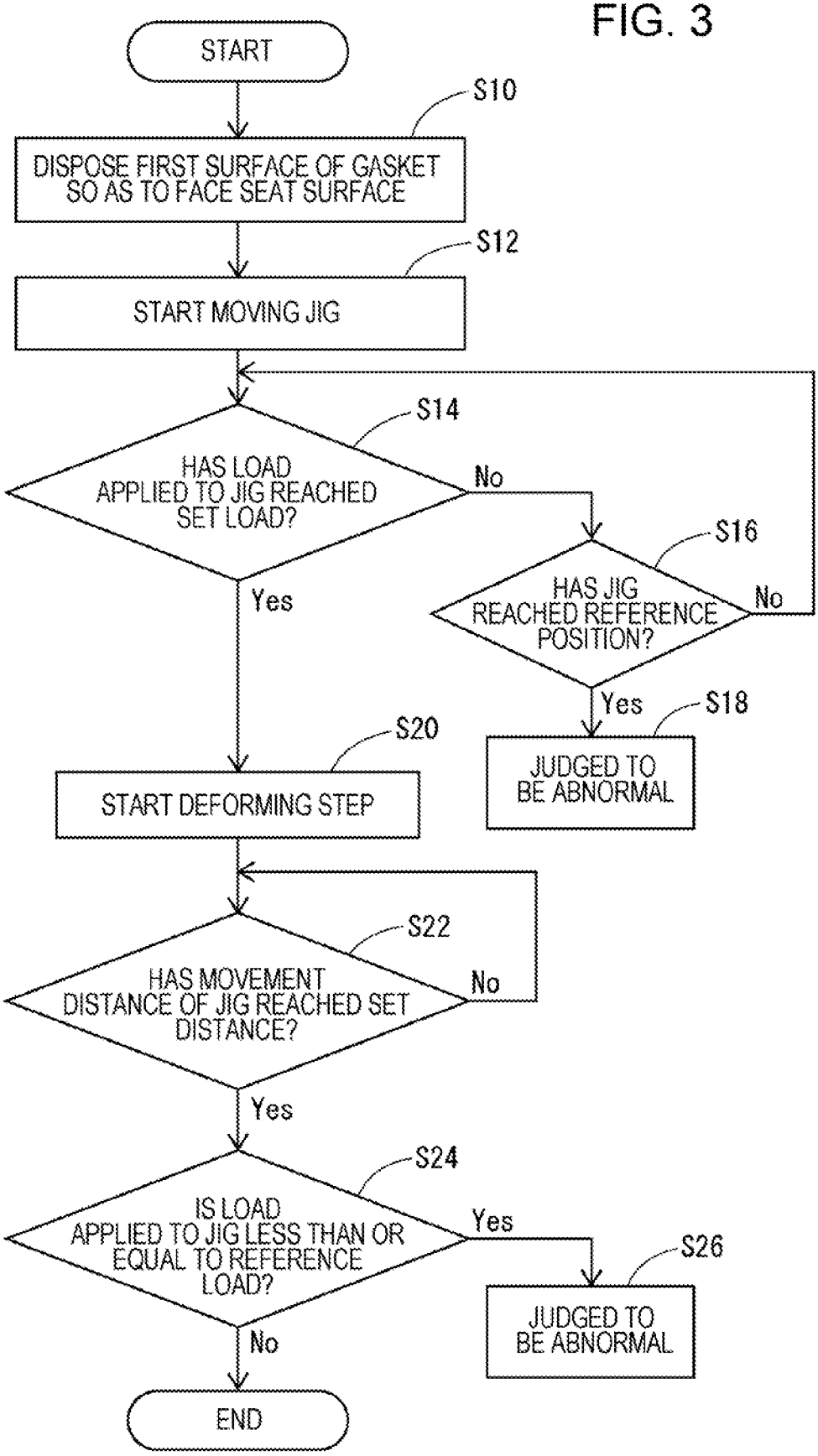
FIG. 3 is a flow chart illustrating the process flow of mounting a gasket onto a metal shell.

In the disposing step, Step S10 is performed (see FIG. 3). In Step S10, the mounting screw portion 30 is inserted into the gasket 50. Then, the gasket 50 is disposed on the seat surface 33 around the mounting screw portion 30 such that the first surface 52 faces the seat surface 33. At this time, the claw portion 64 faces the second surface 54 of the gasket 50 in the direction of the first axial line AX1. That is, the front end side of the spark plug 1 and the rear end side of the jig 60 face the same direction, and the front end side of the spark plug 1 and the front end side of the jig 60 face each other. At this time, the jig 60 is placed at an initial position P0 (see FIG. 4A), and the claw portion 64 and the gasket 50 are disposed apart from each other by a predetermined interval.

The contacting step is a step of bringing, from the front end side of the spark plug 1, the jig 60 into contact with the gasket 50 disposed by performing the disposing step, and moving the jig 60 toward the rear end side of the spark plug 1 until the load applied to the jig 60 from the gasket 50 reaches a predetermined set load. In other words, the contacting step is a step of moving the jig 60 along the direction of the first axial line AX1 relative to the gasket 50 disposed by performing the disposing step, thereby bringing the jig 60 into contact with the second surface 54, which is on the opposite side of the first surface 52, of the gasket 50, and moving the jig 60 toward the rear end side of the spark plug 1 until the load applied to the jig 60 from the gasket 50 reaches the predetermined set load.

In the contacting step, Steps S12, S14, S16, and S18 are performed. In Step S12, the pressing machine 70 starts to move the jig 60. More specifically, the pressing machine 70 moves the jig 60 along the direction of the first axial line AX1 relative to the gasket 50 disposed by performing the disposing step. By moving the jig 60 toward the rear end side of the spark plug 1, the pressing machine 70 causes the contact surface 65 of the jig 60 to come into contact with the second surface 54 of the gasket 50. The pressing machine 70 stores the initial position P0 before the jig 60 starts to move, and measures the movement distance of the jig 60 with reference to the initial position P0.

In Step S14, on the basis of the signal SG2 received from the load detecting portion 74, the pressing machine 70 judges whether or not the load applied to the jig 60 has reached the set load. For example, in a state where the jig 60 does not contact the gasket 50, the pressing machine 70 judges that the load applied to the jig 60 has not reached the set load since the load applied to the jig 60 is less than the set load.

When the pressing machine 70 has judged that the load applied to the jig 60 has not reached the set load (Step S14: NO), the pressing machine 70 judges in Step S16 whether or not the jig 60 has reached a reference position PS. The reference position PS is a position that cannot be reached by the jig 60 in the contacting step. The pressing machine 70 may judge whether or not the jig 60 has reached the reference position PS, for example, based on the movement distance from the initial position P0, or based on information of the reference position PS as an absolute position which has been previously stored.

When the pressing machine 70 has judged that the jig 60 has reached the reference position PS (Step S16: YES), the pressing machine 70 judges in Step S18 that an abnormality has occurred. That is, the pressing machine 70 judges that an abnormality has occurred when the load applied to the jig 60 has not reached the set load even though the jig 60 which moves relatively along the direction of the first axial line AX1 has reached the predetermined reference position PS. When the pressing machine 70 judges that an abnormality has occurred, the pressing machine 70, for example, stops the operation of the jig 60.

Figure 4B:
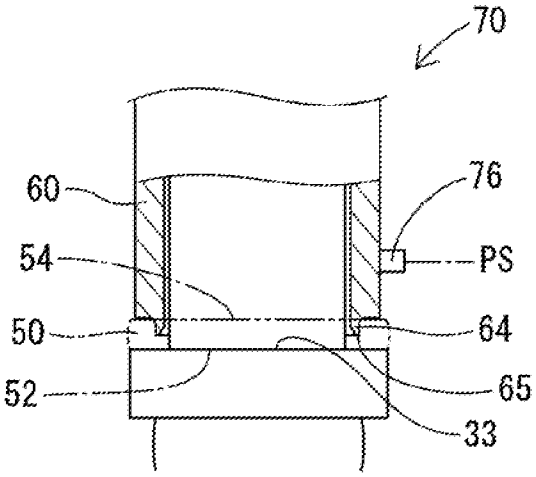
FIG. 4B is an explanatory view illustrating a state in which, in the contacting step, a jig has reached a reference position.
Figure 4A:
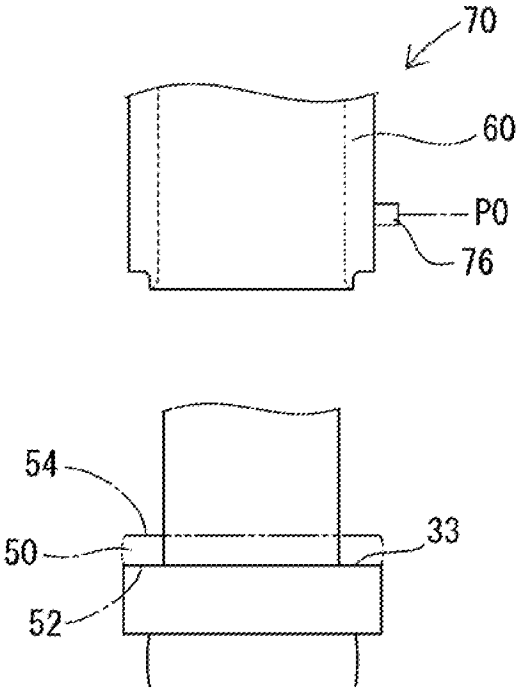
FIG. 4A is an explanatory view illustrating a state in which a contacting step is started without disposing the gasket.

FIGS. 4A and 4B illustrate an example of an operation when the pressing machine 70 judges in Step S18 that an abnormality has occurred. In the example shown in FIGS. 4A and 4B, the reference position PS is the position that the jig 60 reaches when the contact surface 65 of the claw portion 64 is disposed between the position of the first surface 52 of the gasket 50 and the position of the second surface 54 of the gasket 50 by the disposing step. In a case where the jig 60 is moved without the gasket 50 being disposed on the seat surface 33 in the disposing step as shown in FIG. 4A, the pressing machine 70 judges that an abnormality has occurred when the jig 60 has moved beyond the position of the second surface 54 of the gasket 50 to be disposed on the seat surface 33 by the disposing step and reached the reference position PS shown in FIG. 4B. Thus, it is possible to detect an abnormality in which the gasket 50 is not disposed on the seat surface 33, and also, it is possible to prevent the jig 60 from coming into contact with the seat surface 33.

When the pressing machine 70 has judged that the jig 60 has not reached the reference position PS (Step S16: NO), the process returns to Step S14. That is, the pressing machine 70 repeats Steps S14 and S16 until the pressing machine 70 judges that the load applied to the jig 60 has reached the set load or until the pressing machine 70 judges that the jig 60 has reached the reference position PS. When the pressing machine 70 has judged that the load applied to the jig 60 has reached the set load (Step S14: YES), the process proceeds to the deforming step.

Figures 6A, 6B, 6C:
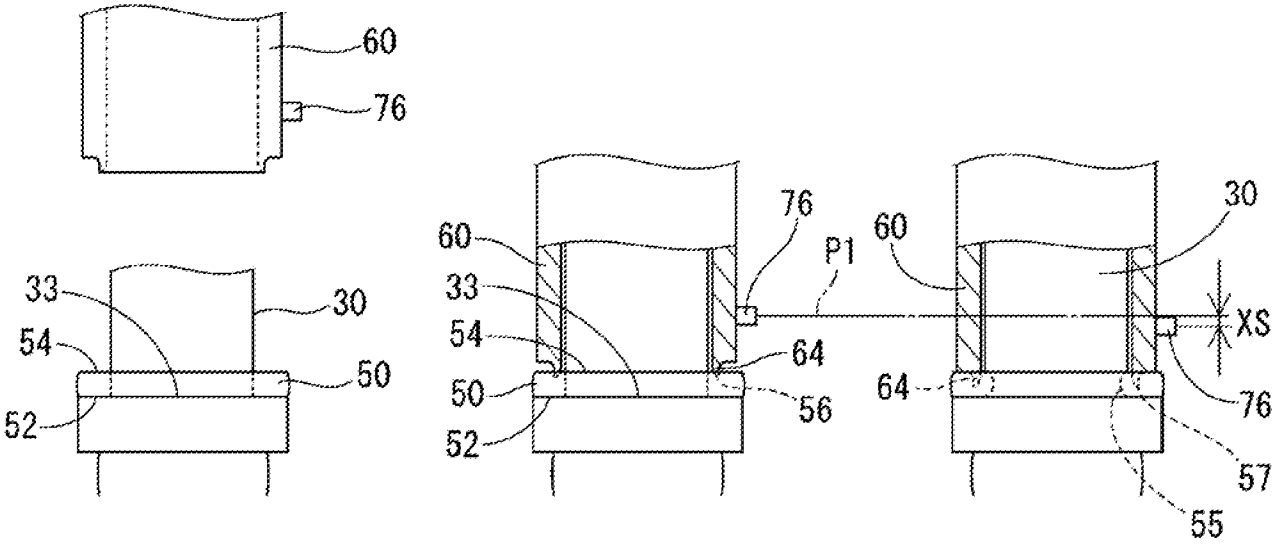
FIG. 6A is an explanatory view illustrating a state in which, in the disposing step, the gasket is disposed in the proper posture.
FIG. 6B is an explanatory view illustrating a state in which, in the contacting step, the load applied to the jig has reached the set load.
FIG. 6C is an explanatory view illustrating a state in which, in the deforming step, the gasket has been properly deformed.

At least when the load applied to the jig 60 has reached the set load, a concave portion 56 is desirably formed in the second surface 54 of the gasket 50 by the pressing action of the jig 60 (see FIG. 6B). That is, the set load is desirably a load that is applied to the jig 60 in a state where only a part of the claw portion 64 of the jig 60 (in particular, a front end portion of the claw portion 64) enters into the second surface 54. By setting the load so to allow the concave portion 56 to be formed as the set load, the set load can be made large enough. Accordingly, for example, in the contacting step (in the stage before proceeding to the deforming step), distortion or warp generated during the punching process is reliably eliminated to form a planar shape, and the gasket 50 that has been disposed in an improper posture is more reliably returned to its proper posture. The deformation of the gasket 50 is caused by the pressing action of the jig 60 while the gasket 50 is sandwiched by the jig 60 and the seat portion 32. Therefore, by forming the concave portion 56 in the second surface 54 of the gasket 50, the contacting step can be finished in a state in which the gasket 50 is sandwiched by the jig 60 and the seat portion 32 having been produced. An improper posture refers to, for example, a posture in which a part of an inner peripheral portion of the gasket 50 is caught by the mounting screw portion 30, and the first surface 52 and the second surface 54 of the gasket 50 are tilted with respect to the seat surface 33. A proper posture refers to a posture in which the first surface 52 of the gasket 50 contacts (surface-contacts) the seat surface 33, and the first surface 52 and the second surface 54 of the gasket 50 are parallel to the seat surface 33. The set load for forming the concave portion 56 in the second surface 54 by the pressing of the jig 60 is desirably, for example. 100 N to 5000 N.

The deforming step is a step of, after the contacting step, further moving the jig 60 toward the rear end side of the spark plug 1 by a predetermined set distance XS, thereby pressing the gasket 50 by the jig 60 and deforming the inner edge portion 55 of the gasket 50 inward in the radial direction of the gasket 50. In other words, the deforming step is a step of, after the contacting step, moving the jig 60 toward the rear end side of the spark plug 1 while pressing the jig 60 against the second surface 54 until the movement distance of the jig 60 reaches the predetermined set distance XS, and deforming the inner edge portion 55 of the gasket 50 inward in the radial direction of the gasket 50.

In the deforming step, Steps S20, S22, S24, and S26 are performed. In Step S20, the pressing machine 70 starts the deforming step. The pressing machine 70 stores the current position of the jig 60 as a position P1 of the jig 60 that is a reference point of measurement of the set distance XS, and begins to measure the movement distance with the stored position P1 of the jig 60 as the reference point. After the load applied to the jig 60 has reached the set load in the contacting step, the pressing machine 70 immediately begins to measure the movement distance. That is, the pressing machine 70 stores the position of the jig 60 when the load applied to the jig 60 has reached the set load as the position P1, and begins to measure the movement distance based on the position of the jig 60 when the load applied to the jig 60 has reached the set load as the reference point.

The pressing machine 70 further moves the jig 60 toward the rear end side of the spark plug 1. At this time, the pressing machine 70 causes the gasket 50 to be pressed by the claw portion 64 in a form of a ring over the entire circumference in a circumferential direction of the gasket 50. In other words, the pressing machine 70 causes the gasket 50 to be pressed by the contact surface 65 while disposing the claw portion 64 adjacent to the gasket 50 in the circumferential direction of the inner edge of the gasket 50.

In Step S22, the pressing machine 70 judges whether or not the movement distance of the jig 60 has reached the set distance XS based on the position of the jig 60 when the load applied to the jig 60 has reached the set load as the reference point. When the pressing machine 70 has judged that the movement distance of the jig 60 has not reached the set distance XS (Step S22: NO), the process returns to Step S22. That is, the pressing machine 70 repeats Step S22 until the pressing machine 70 judges that the movement distance of the jig 60 has reached the set distance XS. When the pressing machine 70 has judged that the movement distance of the jig 60 has reached the set distance XS (Step S22: YES), the pressing machine 70 performs Step S24.

In Step S24, the pressing machine 70 judges whether or not the load applied to the jig 60 is less than or equal to a predetermined reference load. The reference load, for example, is a load that is smaller than the load that should be applied to the jig 60 when the jig 60 has properly deformed the gasket 50. When the pressing machine 70 has judged that the load applied to the jig 60 is less than or equal to the reference load (Step S24: YES), the pressing machine 70 judges in Step S26 that an abnormality has occurred. That is, the pressing machine 70 judges that an abnormality has occurred when the load applied to the jig 60 is less than or equal to the predetermined reference load even after the movement distance of the jig 60 has reached the set distance XS. When the pressing machine 70 has judged that an abnormality has occurred, the pressing machine 70, for example, stops the operation of the jig 60.

When the pressing machine 70 has judged in Step S24 that the load applied to the jig 60 is not less than or equal to the predetermined reference load (Step S24: NO), the pressing machine 70 ends the deforming step and finishes the process of mounting the gasket 50 onto the mounting screw portion 30. Consequently, the concave portion 56 becomes a second concave portion 57 that is further expanded, and the gasket 50 is properly deformed. That is, the inner edge portion 55 of the gasket 50 is deformed inward in the radial direction of the gasket 50 so as to prevent the gasket 50 from coming off from the mounting screw portion 30.

FIGS. 5A to 5F illustrate examples of operations of the pressing machine 70 when the gasket 50 is disposed in an improper posture.

Figures 5A, 5B, 5C, 5D, 5E, 5F:
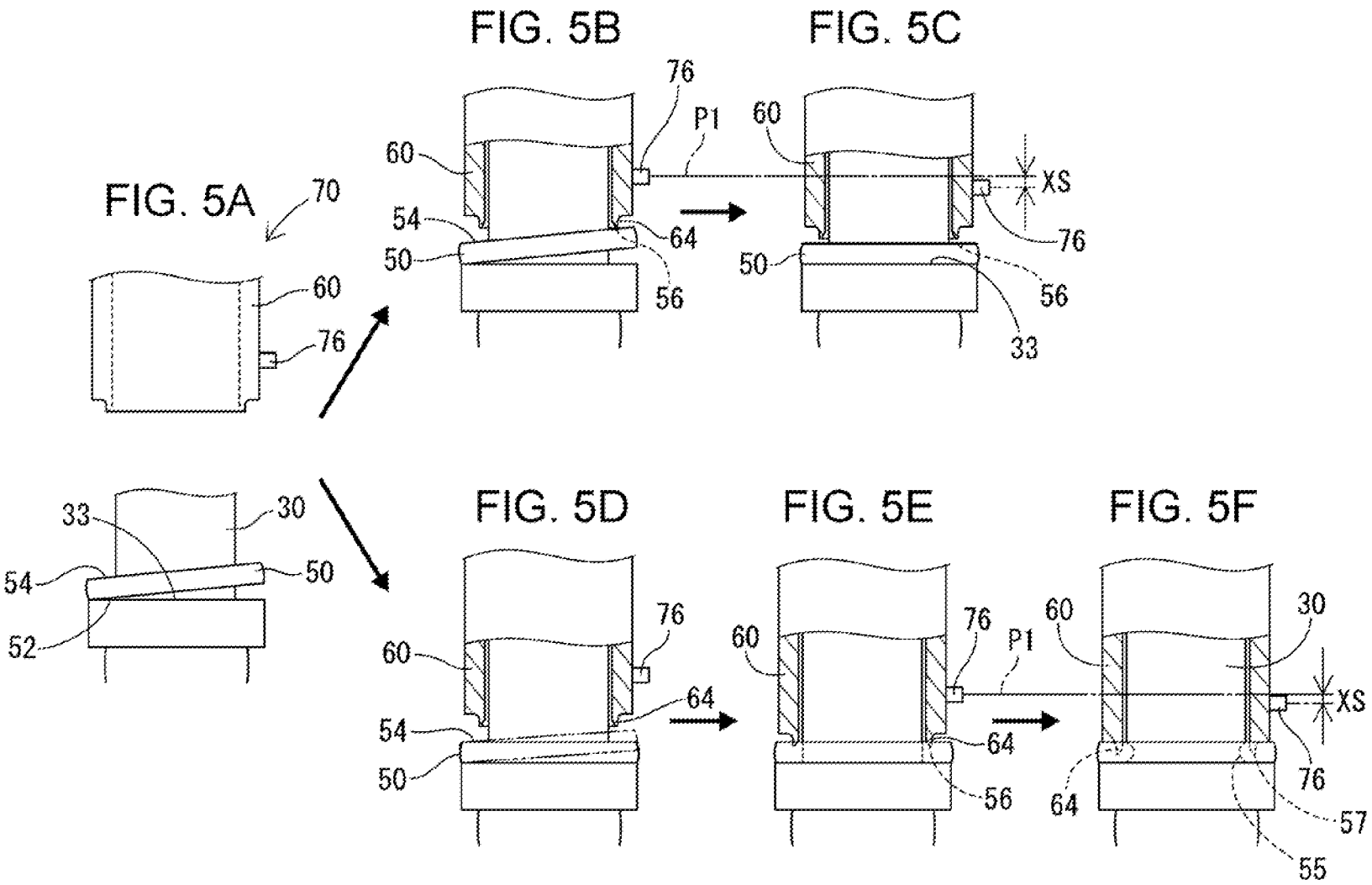
FIG. 5A is an explanatory view illustrating a state in which, in a disposing step, the gasket has been disposed in an improper posture.
FIG. 5B is an explanatory view illustrating a state in which a load applied to the jig has reached a set load with the gasket in the improper posture.
FIG. 5C is an explanatory view illustrating a state in which an abnormality is judged to have occurred because the load applied to the jig is less than or equal to a reference load even though a movement distance of the jig has reached a set distance.
FIG. 5D is an explanatory view illustrating a state in which the posture of the gasket has assumed a proper posture since the gasket has been pressed by the jig.
FIG. 5E is an explanatory view illustrating a state in which, in the contacting step, the load applied to the jig has reached the set load.
FIG. 5F is an explanatory view illustrating a state in which, in a deforming step, the gasket has been properly deformed.

As shown in FIG. 5A, in the disposing step, the gasket 50 is disposed in such a posture that the first surface 52 and the second surface 54 are tilted with respect to the seat surface 33 (improper posture) with a part of the inner peripheral portion of the gasket 50 being caught by the mounting screw portion 30.

In the contacting step, the jig 60 moves toward the rear end side of the spark plug 1. Then, a part of the contact surface 65 of the jig 60 comes into contact with the second surface 54 of the gasket 50. At this time, if the load applied to the jig 60 has reached the set load before the gasket 50 is disengaged from the mounting screw portion 30 by being pressed by the jig 60, the contacting step is finished with the gasket 50 being tilted as shown in FIG. 5B. Thereafter, the pressing machine 70 causes the movement distance of the jig 60 to reach the set distance XS. However, during the process in which the movement distance of the jig 60 reaches the set distance XS, if the gasket 50 is disengaged from the mounting screw portion 30 and disposed on the seat surface 33 in a proper posture, the gasket 50 is not sufficiently pressed by the claw portion 64, as shown in FIG. 5C, even if the movement distance of the jig 60 reaches the set distance XS. In this case, the pressing machine 70 judges that the load applied to the jig 60 is less than or equal to the reference load, so that the occurrence of an abnormality can be detected (Step S26).

In contrast, in the contacting step, the gasket 50 may be disengaged from the mounting screw portion 30 by being pressed by the jig 60 before the load applied to the jig 60 reaches the set load, and the gasket 50 may be disposed on the seat surface 33 in a proper posture. In the example shown in FIG. 5D, the jig 60 presses the gasket 50 in the improper posture, and thereby the gasket 50 is disengaged from the mounting screw portion 30 and disposed on the seat surface 33 in the proper posture. In the example shown in FIG. 5D, the load applied to the jig 60 has not reached the set load. Then, as shown in FIG. 5E, when the jig 60 has exerted the set load onto the gasket 50 in the proper posture, the pressing machine 70 judges that the load applied to the jig 60 has reached the set load. At this time, the concave portion 56 is formed in the second surface 54. Further, as shown in FIG. 5F, the pressing machine 70 causes the movement distance of the jig 60 to reach the set distance XS. When the movement distance of the jig 60 has reached the set distance XS, the pressing machine 70 judges that the load applied to the jig 60 is not less than or equal to the reference load. When the movement distance of the jig 60 has reached the set distance XS, the claw portion 64 is in a state where a portion up to the vicinity of a front end of the second outer surface 69 enters into the gasket 50. As a result, the concave portion 56 of the gasket 50 becomes the second concave portion 57 that is further expanded, and the inner edge portion 55 of the gasket 50 is deformed inward in the radial direction of the gasket 50.

FIGS. 6A to 6C illustrate an example of an operation of the pressing machine 70 when the gasket 50 has been disposed in the proper posture. As shown in FIG. 6A, in the disposing step, the gasket 50 is disposed on the seat surface 33 in the proper posture. As shown in FIG. 6B, in the contacting step, the pressing machine 70 moves the jig 60 relative to the gasket 50 along the direction of the first axial line AX1 so that the jig 60 is brought into contact with the second surface 54 of the gasket 50, and moves the jig 60 toward the rear end side of the spark plug 1 until the load applied to the jig 60 from the gasket 50 reaches the set load. As a result, the concave portion 56 is formed in the second surface 54 of the gasket 50. Further, as shown in FIG. 6C, in the deforming step, the pressing machine 70 moves the jig 60 toward the rear end side of the spark plug 1 while pressing the jig 60 against the second surface 54 until the movement distance of the jig 60 reaches the set distance XS, and deforms the inner edge portion 55 of the gasket 50 inward in the radial direction of the gasket 50. As a result, the concave portion 56 of the gasket 50 becomes the second concave portion 57 that is further expanded, and the inner edge portion 55 of the gasket 50 is deformed inward in the radial direction of the gasket 50.

1-5. Effects of the Invention

The spark plug 1 according to the first embodiment includes the cylindrical metal shell 20 and the gasket 50. The metal shell 20 includes the mounting screw portion 30 that is formed at the outer periphery of the front end side of the metal shell 20, and the seat portion 32 that is provided on the rear end side of the mounting screw portion 30 and that protrudes outward in the radial direction. The gasket 50 has a solid ring-shaped structure and is disposed between the mounting screw portion 30 and the seat portion 32.

The method of manufacturing the spark plug 1 according to the first embodiment includes the disposing step, the contacting step, and the deforming step. The disposing step is a step of inserting the mounting screw portion 30 into the gasket 50 and disposing the gasket 50 between the mounting screw portion 30 and the seat portion 32. The contacting step is a step of bringing, from the front end side, the jig 60 into contact with the gasket 50 disposed by performing the disposing step, and moving the jig 60 toward the rear end side until the load that is applied to the jig 60 from the gasket 50 reaches the predetermined set load. The deforming step is a step of, after the contacting step, further moving the jig 60 toward the rear end side by the predetermined set distance XS, thereby pressing the gasket 50 by the jig 60 and deforming the inner edge portion 55 of the gasket 50 inward in the radial direction of the gasket 50.

According to this configuration, after the load applied from the gasket 50 has reached the set load, the jig 60 moves toward the rear end side of the spark plug 1 by the set distance XS. Therefore, after the jig 60 has come into contact with the gasket 50 and has been subjected to the set load, the jig 60 is further pressed into the gasket 50 by the set distance XS. Thus, by preventing the pressing depth of the jig 60 into the gasket 50 from being smaller than expected, a situation in which the inner edge portion 55 of the gasket 50 is not sufficiently deformed inward in the radial direction due to the pressing depth of the jig 60 into the gasket 50 being smaller than expected can be avoided. Therefore, according to this configuration, it is possible to reliably prevent the gasket 50 from coming off from the mounting screw portion 30.

For example, although a peripheral edge portion of the contact surface 65 of the jig 60 is angular when unused, the peripheral edge portion of the contact surface 65 wears and becomes rounded by repeatedly pressing and deforming the gasket 50. Accordingly, the frictional force applied to the jig 60 when the jig 60 presses and deforms the gasket 50 is increased as the jig 60 repeatedly presses and deforms the gasket 50. Therefore, in a case where it is judged that the gasket 50 has been deformed properly when the load applied to the jig 60 has exceeded a threshold value, the pressing depth of jig 60 into the gasket 50 becomes smaller by a distance corresponding to the increased frictional force as the jig 60 repeatedly presses and deforms the gasket 50. However, according to this configuration, even if the peripheral edge portion of the contact surface 65 wears, the jig 60 can be pressed into the second surface 54 of the gasket 50 by a depth equal to the set distance XS.

Therefore, according to this configuration, it is possible to reliably prevent the gasket 50 from coming off from the mounting screw portion 30.

In particular, the pressing machine 70 stores the position P1 of the jig 60 when the load applied to the jig 60 from the gasket 50 has reached the predetermined set load in the contacting step. Then, in the deforming step, the pressing machine 70 further moves the jig 60 toward the rear end side from the position P1 by the set distance XS, and thereby causes the gasket 50 to be pressed by the jig 60 so that the inner edge portion 55 of the gasket 50 is deformed inward in the radial direction of the gasket 50. That is, the jig 60 moves toward the rear end side of the spark plug 1 by the set distance XS based on the position P1 when the load applied from the gasket 50 has reached the set load as the reference point. Therefore, according to this configuration, it is possible to adjust the pressing distance of the jig 60 into the gasket 50 with higher accuracy.

Further, in the contacting step, the concave portion 56 is formed in the gasket 50 by the pressing action of the jig 60 at least when the load applied to the jig 60 has reached the set load.

For example, when the gasket 50 is disposed in an improper posture so as to be tilted with respect to the seat portion 32 and the contacting step is finished with the gasket 50 in the improper posture, the jig 60 is to be further moved toward the rear end side of the spark plug 1 by the set distance XS from a state in which the gasket 50 is not sandwiched by the jig 60 and the seat portion 32. As a result, the gasket 50 may not be properly deformed.

However, according to this configuration, in the contacting step, a load that allows the concave portion 56 to be formed in the gasket 50 is exerted upon the gasket 50, and when the load reaches the set load, the concave portion 56 is formed in the gasket 50 by the pressing action of the jig 60. Therefore, for example, even if the gasket 50 is disposed in the improper posture, the posture of the gasket 50 is corrected to the proper posture by being subjected to a load that allows the concave portion 56 to be formed, before proceeding to the deforming step. Then, the contacting step can be finished with a state in which the gasket 50 is sandwiched by the jig 60 and the seat portion 32 having been produced. Therefore, according to this configuration, a situation that the gasket 50 is not properly deformed due to the deforming step being started with the gasket 50 in an improper posture can be avoided.

Further, when the gasket 50 is manufactured by punching a metallic disk, the gasket 50 may be, for example, distorted or warped. However, according to this configuration, in the stage before proceeding to the deforming step, the distortion or warp generated during the punching process is easily eliminated. Therefore, it is easy to proceed to the deforming step with the distortion or warp generated during the punching process having been eliminated. Consequently, it is possible to prevent the situation in which the gasket 50 is not properly deformed.

Further, the jig 60 includes the ring-shaped claw portion 64 on one end thereof. In the deforming step, the gasket 50 is pressed by the claw portion 64 in a form of a ring over the entire circumference in the circumferential direction of the gasket 50.

According to this configuration, since pressure is easily exerted uniformly over the entire circumference in the circumferential direction of the gasket 50, the gasket 50 is easily deformed uniformly over the entire circumference in the circumferential direction.

Further, in the contacting step, an abnormality is judged to have occurred when the load applied to the jig 60 has not reached the set load even though the jig 60 has reached the predetermined position PS.

According to this configuration, when the load applied to the jig 60 has not reached the set load even though the jig 60 has reached the position where the load applied to the jig 60 should reach the set load, it is possible to detect that an abnormality has occurred.

Further, in the deforming step, an abnormality is judged to have occurred when the load applied to the jig 60 is less than or equal to the predetermined reference load even after the jig 60 has moved by the set distance XS.

For example, when the gasket 50 has been disposed in an improper posture that is tilted with respect to the seat portion 32 and the contacting step has been finished with the gasket 50 in the improper posture, the jig 60 is to be further moved toward the rear end side of the spark plug 1 by the set distance XS from the state in which the gasket 50 is not sandwiched by the jig 60 and the seat portion 32. As a result, the gasket 50 may not be properly deformed. However, according to this configuration, the occurrence of such an abnormality is easily detected. The details are as follows.

For example, in a case where the load applied to the jig 60 has reached the set load with the gasket 50 in an improper state, the posture of the gasket 50 may be corrected to the proper posture thereafter when the jig 60 has further pressed the gasket 50 in the deforming step. When the posture of the gasket 50 assumes the proper posture, the gasket 50 becomes movable between the jig 60 and the seat portion 32, so that a pressing force from the jig 60 is not easily exerted on the gasket 50. Therefore, a situation in which the load applied to the jig 60 is less than or equal to the predetermined reference load when the jig 60 has moved by the set distance XS may occur. When the load applied to the jig 60 is less than or equal to the predetermined reference load even after the jig 60 has moved by the set distance XS, an abnormality is judged to have occurred by the above-described configuration.

Therefore, an occurrence of an abnormality in which the gasket 50 is not properly deformed due to the gasket 50 being disposed in an improper posture is easily detected.

Further, the gasket 50 is preferably a copper gasket.

According to this configuration, the gasket 50 can be a gasket having a high sealability and durability.

Other Embodiments

The invention is not limited to the above-described embodiment. For example, the following embodiments are also included in the technical scope of the present invention. Various features of the above-described embodiment and the embodiments described below may be combined as long as the combinations do not give rise to inconsistencies.

In the first embodiment, the position P1 of the jig 60, which is the reference point of measurement of the set distance XS, is the position of the jig 60 when the load applied to the jig 60 from the gasket 50 has reached the predetermined set load. However, the position P1 of the jig 60, which is the reference point of measurement of the set distance XS, may be a position that the jig 60 reaches after the load applied to the jig 60 from the gasket 50 has reached the predetermined set load, and need not be the position of the jig 60 when the load applied to the jig 60 from the gasket 50 has reached the predetermined set load. For example, the position that the jig 60 reaches after a predetermined time (for example, 0.5 seconds) has elapsed since the load applied to the jig 60 from the gasket 50 has reached the predetermined set load may be defined as the position P1 of the jig 60, which is the reference point of measurement of the set distance XS. In this case, since the pressing machine 70 is not required to be highly responsive, manufacturing is facilitated.

In the first embodiment, although the contact surface 65 has a ring shape, the contact surface 65 need not have a ring shape. For example, the contact surface 65 may have a plurality of contact surfaces that are disposed apart from each other.

In the first embodiment, although the gasket 50 is a copper gasket, the gasket 50 may be a gasket other than a copper gasket. For example, the gasket 50 may be an iron gasket.

In the first embodiment, although the pressing machine 70 stops the operation of the jig 60 in Step S18 when it is determined that the answer is YES in Step S16, this mechanism may be omitted. Similarly, the mechanism for stopping the operation of the jig 60 in Step S26 when it is determined that the answer is YES in Step S24 may also be omitted. This is because as long as the gasket 50 is reliably disposed on the seat surface 33 in Step S10 with the first surface 52 facing the seat surface 33, the answers in Steps S16 and S24 are never determined to be YES. It is possible to properly dispose the gasket 50 on the seat surface 33 by disposing the gasket 50, for example, by a manual operation.

The invention has been described in detail with reference to the above embodiments. However, the invention should not be construed as being limited thereto. It should further be apparent to those skilled in the art that various changes in form and detail of the invention as shown and described above may be made. It is intended that such changes be included within the spirit and scope of the claims appended hereto.

This application is based on Japanese Patent Application No. JP 2019-032668 filed Feb. 26, 2019, incorporated herein by reference in its entirety.

What is claimed is:

1. A method of manufacturing a spark plug, the spark plug comprising:

a cylindrical metal shell that includes a mounting screw portion and a seat portion, the mounting screw portion being formed at an outer periphery of a front end side of the metal shell, the seat portion being provided on a rear end side of the mounting screw portion and protruding outward in a radial direction, and a gasket that has a solid ring-shaped structure and that is disposed between the mounting screw portion and the seat portion, the method comprising:

a disposing step of inserting the mounting screw portion into the gasket and disposing the gasket between the mounting screw portion and the seat portion;

a contacting step of bringing, from the front end side, a jig into contact with the gasket disposed by performing the disposing step, moving the jig to a position P1 toward the rear end side until a load that is applied to the jig from the gasket reaches a predetermined set load; and a deforming step of, after the contacting step, further moving the jig toward the rear end side by a predetermined set distance from position P1 to thereby press the gasket by the jig and deform an inner edge portion of the gasket inward in a radial direction of the gasket.

2. The method of manufacturing a spark plug as claimed in claim 1, wherein in the contacting step, the gasket is pressed by the jig to form a concave portion in the gasket at least when the load applied to the jig has reached the set load.

3. The method of manufacturing a spark plug as claimed in claim 1, wherein the jig includes a ring-shaped claw portion on one end of the jig, and in the deforming step, the gasket is pressed by the claw portion in a form of a ring over an entire circumference in a circumferential direction of the gasket.

4. The method of manufacturing a spark plug as claimed in claim 1, wherein in the contacting step, an abnormality is judged to have occurred when the load applied to the jig has not reached the set load even though the jig has reached a predetermined reference position.

5. The method of manufacturing a spark plug as claimed in claim 1, wherein in the deforming step, an abnormality is judged to have occurred when the load applied to the jig is less than or equal to a predetermined reference load even after the jig has moved by the set distance.

6. The method of manufacturing a spark plug as claimed in claim 1, wherein the gasket is a copper gasket.

7. The method of manufacturing a spark plug as claimed in claim 1, wherein said contacting step comprises storing the position of the jig as position P1 when the applied load reaches the predetermined load, and said deforming step comprises measuring the movement distance of the jig from position P1 to determine whether the movement distance has reached the predetermined set distance.

* * * * *